US005955935A

United States Patent [19]

Proctor

[11] Patent Number: 5,955,935

[45] Date of Patent: Sep. 21, 1999

[54] ELECTROMAGNET DESIGN

[75] Inventor: Robert Ray Proctor, Pleasant Grove, Utah

[73] Assignee: Geneva Steel, Provo, Utah

[21] Appl. No.: 09/055,529

[22] Filed: Apr. 6, 1998

[51] Int. Cl.[6] ..... H01F 7/20

[52] U.S. Cl. ..... 335/291; 335/294

[58] Field of Search ..... 335/289, 290, 335/291, 292, 293, 294, 295

[56] References Cited

U.S. PATENT DOCUMENTS 4,103,266 7/1978 Schwartz .
4,162,471 7/1979 Peace et al. .
4,264,887 4/1981 Barrett .
4,314,219 2/1982 Haraguchi .
4,378,547 3/1983 Goedhart et al. .
4,378,548 3/1983 Rybak .
5,038,128 8/1991 Georgiev et al. .
5,410,289 4/1995 Futa .

*Primary Examiner*—Lincoln Donovan
*Attorney, Agent, or Firm*—Madson & Metcalf

[57] ABSTRACT

Disclosed is an electromagnet design that can be quickly disassembled, repaired, and reassemble. In one embodiment the electromagnet comprises a housing having a housing cavity. Carved or molded into the housing is a pair of opposing slots. An electromagnetic core comprising a ferromagnetic material wrapped with electrical wire is disposed within the housing cavity. A pair of braces are lodged within the slots in the housing cavity such that they overlap the electromagnetic core. A center shoe engages the braces and is secured to the housing by six bolts. The slots, braces, and center shoe design cooperate to secure the electromagnetic core within the housing cavity.

17 Claims, 5 Drawing Sheets

ELECTROMAGNET DESIGN

1. THE FIELD OF THE INVENTION

The present invention relates to an improved lifting electromagnet. More particularly, the present invention relates to an improved lifting electromagnet or an improved and more simple design than existing electromagnets so that the electromagnet can be quickly disassembled, repaired and reassembled, all at reduced cost.

2. BACKGROUND

As is well known, magnets have a pair of poles, generally designated a north pole and a south pole. Like poles repel each other while opposite poles are attracted. Magnets attract ferromagnetic objects such as iron, nickel, cobalt and gadolinium. Ferromagnetic objects are made up of small regions called domains. Each domain may behave in the same manner as a small magnet having two poles, a north pole and a south pole. In an unmagnetized piece of ferromagnetic material, the domains are randomly arranged, thus canceling the magnetic effect. When a magnet is placed in close proximity to an unmagnetized piece of ferromagnetic material, however, the domains become temporarily aligned. The temporary alignment of the domains causes the north pole of the domains to attract the south pole of the magnet, and visa versa.

It is a well known law of physics that an electrical current produces a magnetic field. In a straight segment of wire carrying an electrical current, the magnetic field forms a cylindrical region having the wire as its central axis. When a wire forms a circle or loop, the loop creates a magnetic field that circumscribes the wire loop. The ends of the magnetic field created by the looped wire carrying current resembles a magnet; the end where the magnetic field enters acts as a south pole and the end where the magnetic field exits acts as a north pole.

A long coil of wire consisting of multiple loops is referred to as a solenoid. The magnetic field strength of a solenoid is the sum of the fields created by each individual loop, multiplied by the amperes running through the wire. Placing a piece of iron in the center of a solenoid creates an electromagnet. The iron greatly increases the magnetic strength of the solenoid because the domains in the iron become aligned by the magnetic field created by the current. Thus, the resulting magnetic field is the sum of the current running through the circular wire plus the magnetic field created by the aligned domains in the iron. The iron typically used in electromagnets is referred to as soft iron because it quickly loses its magnetism once the current in the wire is cut off and quickly regains magnetism once the current is turned on.

Electromagnets of the type described above are commonly used to lift large ferromagnetic objects. In the steel industry, for example, large electromagnets are used to pick up large plates of hot steel as they come off the press. The temperature of the steel plates can exceed temperatures of 1100–1200° F. These extreme temperatures create several problems for electromagnets.

First, ferromagnetic materials, such as steel, lose their magnetic characteristics at a temperature known as the Curie temperature or point (about 1400° F). At the Curie point, the high temperature re-randomizes the domains in the ferromagnetic material. Thus, a greater magnetic force is required to lift hot steel than cold steel. Moreover, as heat from the steel plates is transferred to the iron core of the electromagnet, the electromagnet itself loses some of its magnetic power.

Second, the heat from the steel plates damages the insulation surrounding the electrical wire coiled around the iron core of the electromagnet. The increasing temperature of the electrical wire is aggravated by heat generated by the current running through the electrical wire itself. The heat (or power) generated by the electrical coil is defined by the equation $I^2R$, where I is amperage and R is resistance. Thus, an increase in either amperage or resistance increases the heat generated by the electrical coil. With time, the excessive heat damages the insulation around the electrical wire. Eventually, the wire short circuits and the electromagnet loses its magnetic properties.

It will be appreciated that to repair electromagnets whose electrical wire has been damaged by heat, the electromagnet must be disassembled in order to gain access to the iron core and coiled electrical wire. And, once the electrical wire is replaced, the electromagnet must be reassembled. This seemingly easy task is made exceedingly arduous and tedious by conventional electromagnets which are designed with upwards of 24 bolts. To save time, rather than unscrewing the bolts, technicians often cut the bolts with a torch and replace them with new ones. Reassembly is also tedious. Prior art electromagnet designs require that the bolt holes in multiple heavy cast iron plates be perfectly aligned with the bolt holes in the magnet housing before the electromagnet can be assembled. At times, the task of properly aligning all the of metal plates of the electromagnet takes multiple technicians several hours. During this time the production line is often paralyzed.

From the foregoing, it will be appreciated that it would be an advancement in the art to provide an electromagnet that is simple, easy to assemble and disassemble, and inexpensive to build and maintain. In that regard it would be an advancement in the art to provide an electromagnet that could be easily and quickly assembled and disassembled, reducing the amount of down time resulting from damaged electrical coils. To that end, it would be an advancement in the art if the electromagnet design contained fewer bolts. It would be a further advancement in the art if the bolt holes could be easily aligned without the use of heavy lifting equipment. Such an electromagnet design is disclosed and claimed herein.

3. BRIEF SUMMARY AND OBJECTS OF THE INVENTION

The present invention relates to a novel lifting electromagnet design. More particularly, the present invention relates to an improved lifting electromagnet design which allows the electromagnet to be quickly disassembled, repaired, and reassembled. The reduced repair time significantly reduces the amount of the time the production line is disrupted by inoperative electromagnets.

In one embodiment the electromagnet of the present invention comprises a rectangular housing having a housing cavity. Carved or molded into the housing is a pair of opposing slots that run the entire length of the housing cavity. An electromagnetic core comprising a ferromagnetic material wrapped with electrical wire is disposed within the housing cavity. A pair of rectangular braces are lodged within the slots in the housing cavity. When properly positioned within the opposing slots, the braces overlap the electromagnetic core. A center shoe having a lip is positioned between the braces such that the lip engages the braces. A plurality of bolts, preferably six, which pass through the center shoe, the electromagnetic core, and the top face of the housing, secures the center shoe to the housing. As the bolts are tightened, the center shoe becomes biased against the braces, securing the electromagnetic core within the housing cavity.

Thus, unlike previous electromagnet designs, the electromagnet design of the present invention is much easier to assemble and disassemble. Conventional electromagnets use a large heavy cast iron plate and upwards of 24 bolts to secure the electromagnetic core within the housing cavity. In contrast, the electromagnet design of the present invention secures the electromagnetic core within the housing cavity using a pair of slots and braces supported by center shoe and a relatively small number of bolts. In one preferred embodiment, the center shoe is secured with six bolts. In addition, the braces and center shoe of the present invention are relatively light compared to the cast iron plate used in conventional electromagnet designs. Consequently, the bolt holes in the center shoe can be quickly and efficiently aligned without the use of lifting equipment.

One use of the electromagnet of the present invention is in moving large pieces of hot steel. As discussed above, a persistent problem in the art is that the high temperature of the steel damages the insulation of the coiled wire in the electromagnetic core of the magnet. With the present invention, should the coiled wire become damaged, a technician can quickly disassemble, repair and re-assemble the electromagnet of the present invention. The technician first removes the bolts securing the center shoe to the housing. The center shoe is then removed exposing the braces. Finally, the braces are dislodged from the slots in the housing cavity permitting the electromagnetic core to be removed from the housing cavity and repaired. Once the necessary repairs are made, the electromagnetic core is once again placed in the housing cavity. With the electromagnetic core in position, the braces are lodged into the opposing slots such that the brace overlaps the electromagnetic core. The center shoe is then positioned between the braces such that bolt holes are vertically aligned. Finally, the center shoe is secured to the housing by a plurality of bolts.

These and other objects and advantages of the present invention will become more fully apparent by examination of the following description of the preferred embodiments and the accompanying drawings.

4. BRIEF DESCRIPTION OF THE DRAWINGS

A more particular description of the invention summarized above will be rendered by reference to the appended drawings. These drawings only provide information concerning typical embodiments of the invention. Therefore they are not to be considered limiting of its scope. The invention will be described and explained with additional specificity and detail through the use of the accompanying drawings, in which:

FIG. 1 is a side elevational view of one embodiment of the electromagnet design of the present invention.

FIG. 2*a* is a top plan view of the electromagnet of the present invention.

FIG. 2*b* is a cross sectional view of the electromagnet in FIG. 2*a* shown without the electromagnetic core.

Figure 4A:
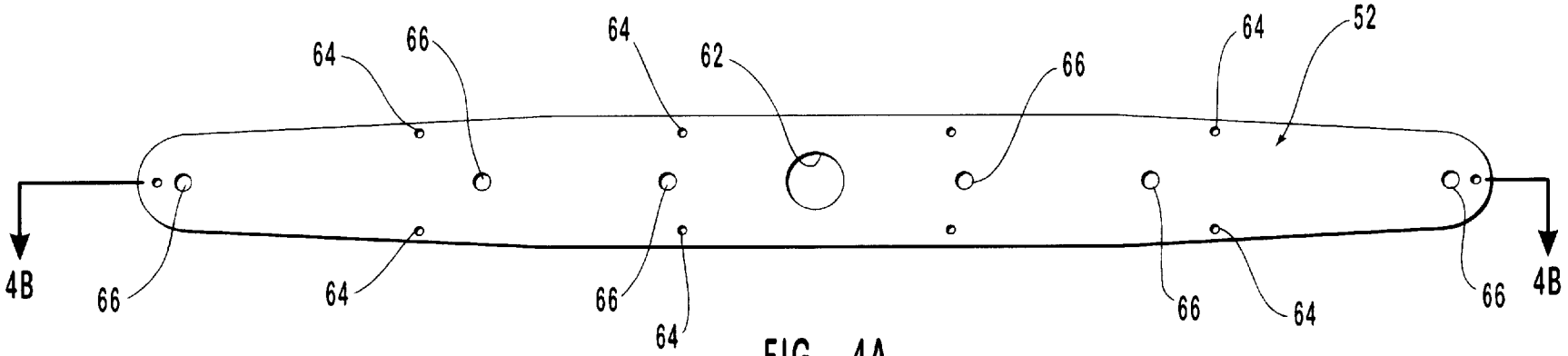
FIG. 4 illustrates the pole piece of the electromagnet of the present invention.

FIG. 4*a* is a top plan view of the pole piece of the electromagnet of the present invention.

Figure 4B:
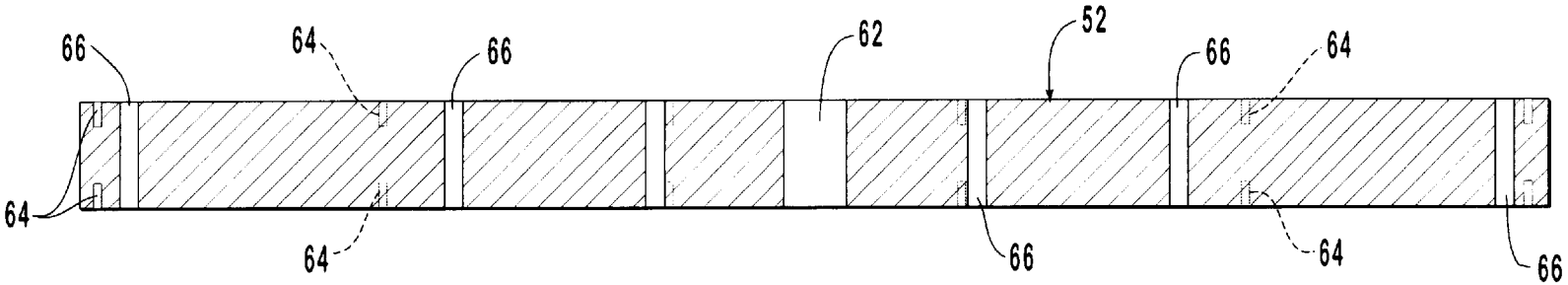

FIG. 4*b* is a cross sectional view of the pole piece shown in FIG. 4*a*.

Figure 5:
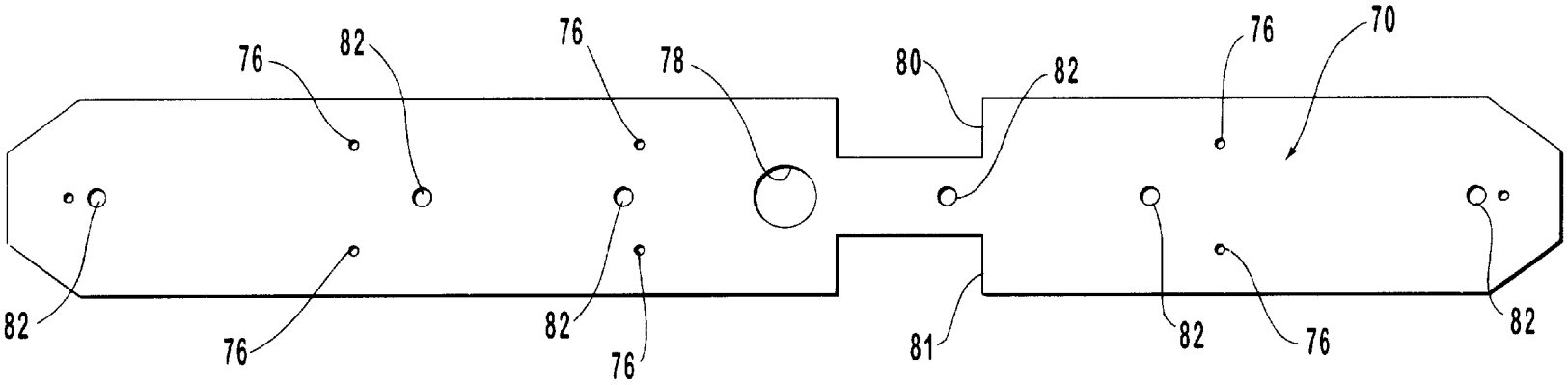

FIG. 5 is a top plan view of the top electromagnetic core plate of the electromagnet of the present invention.

Figure 6:
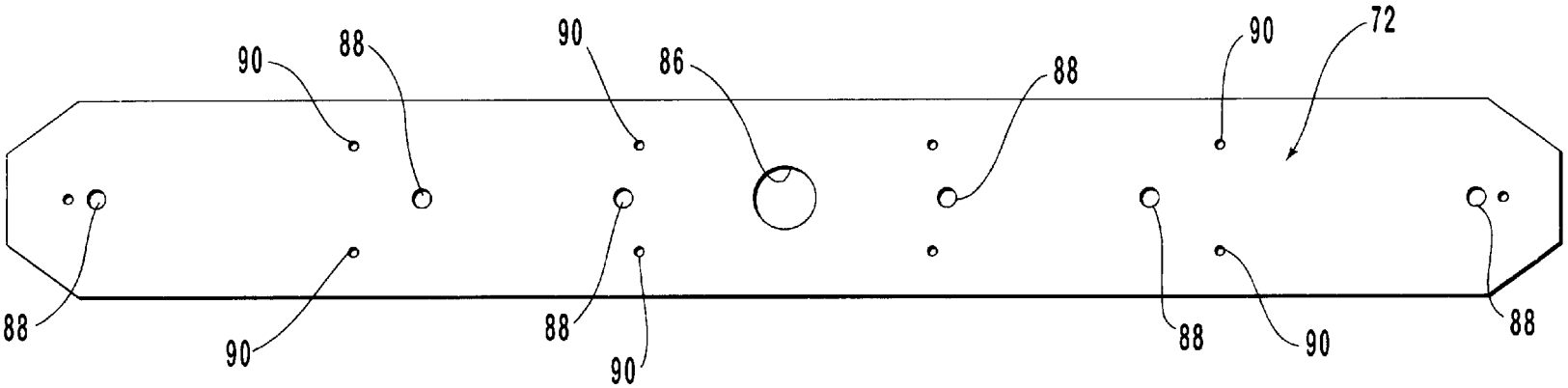

FIG. 6 is a top plan view of the bottom electromagnetic core plate of the electromagnet of the present invention.

FIG. 7 illustrates the center shoe of the electromagnet of the present invention.

Figure 7A:
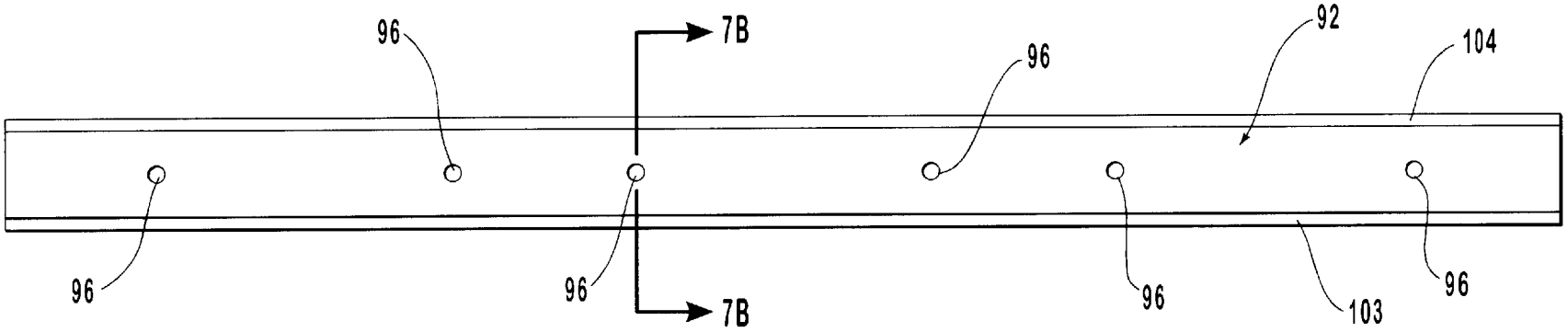

FIG. 7*a* is a top plan view of the center shoe of the electromagnet of the present invention.

Figure 7B:
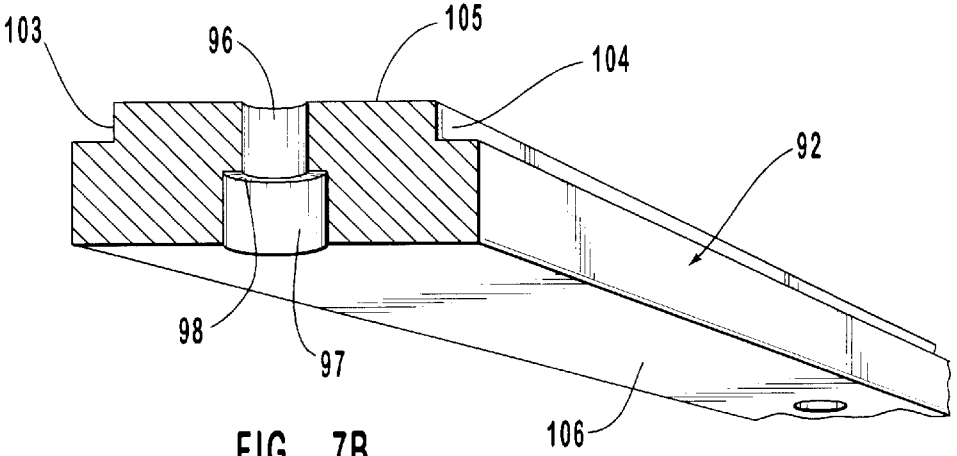

FIG. 7*b* is a cut away perspective view of the center shoe shown in FIG. 7*a*.

5. DETAILED DESCRIPTION OF THE PREFERRED EMBODIMENTS

Figure 1:
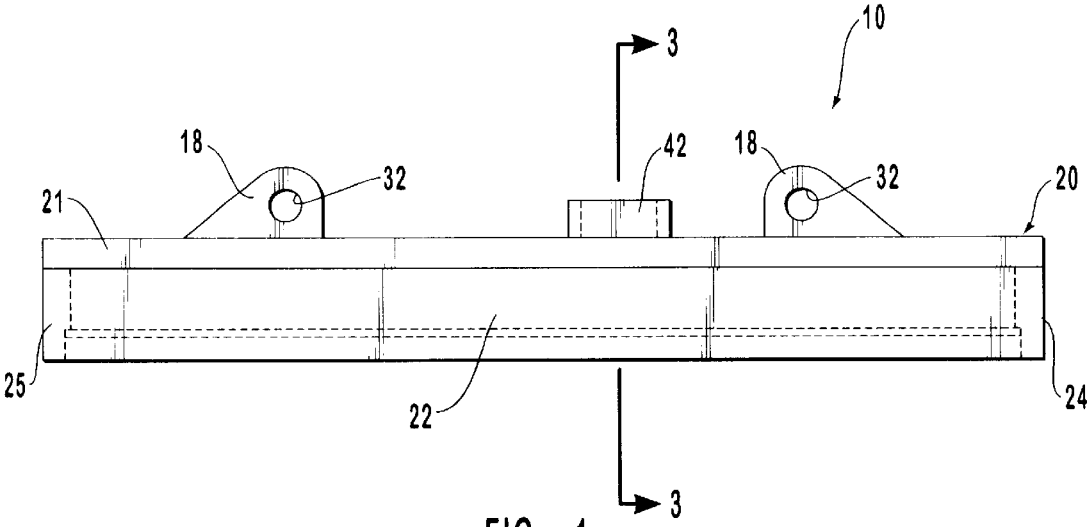
Figure 2A:
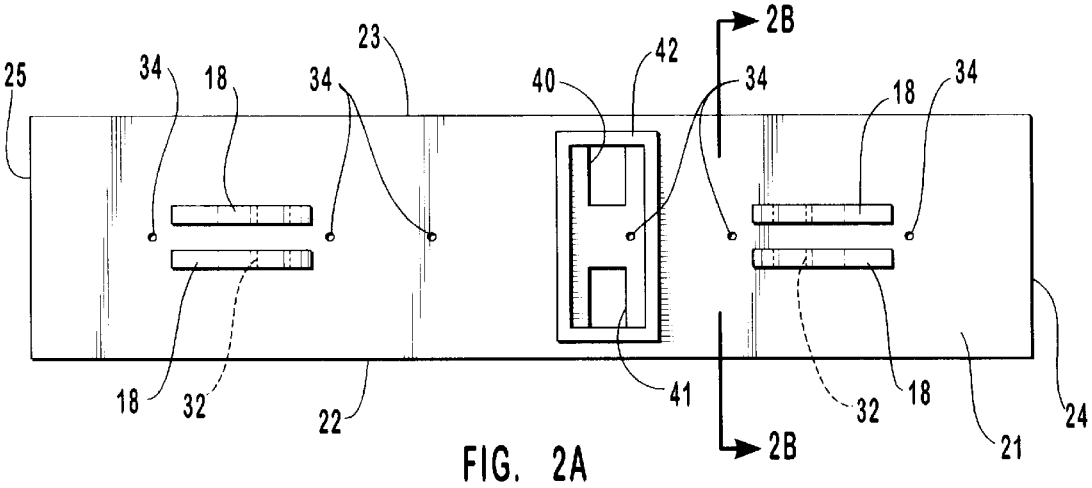
Figure 2B:
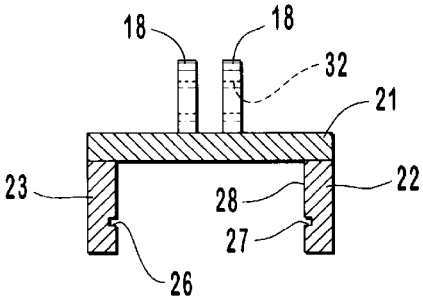

Reference is now made to the figures wherein like parts are referred to by like numerals throughout. With particular reference to FIG. 1, the present invention is an electromagnet generally designated 10. Electromagnet 10 generally comprises a housing 20, an electromagnetic core 50 (illustrated in FIG. 3) disposed therein, and means of securing electromagnetic core 50 within housing 20. In the illustrated embodiment, the electromagnet housing 20 is generally rectangular in shape. Housing 20, however, can take various shapes without departing from the scope of the present invention. As best illustrated in FIGS. 1, 2*a*, and 2*b*, housing 20 comprises a top plate 21, a pair of side plates 22 and 23, and a pair of end plates 24 and 25. Plates 22 through 25 extend downwardly from, and are flush with the ends of top plate 21. In one embodiment, plates 22 through 25 are welded to top plate 21. It will be appreciated by one skilled in the art, however, that plate 21 and plates 22 through 25 can be constructed from a unitary mold.

As best illustrated in FIG. 2*a*, top plate 21 has a plurality of bolt holes 34. In the illustrated embodiment, top plate 21 has six bolt holes 34 which are used to secure electromagnetic core 50 to housing 20. Additionally, housing 20 has a plurality of hooks 18 attached to, and extending above, top plate 21 of housing 20. Each hook 18 has an aperture 32 which is capable of accommodating a suitable cable for elevating electromagnet 10 during operation. As illustrated in FIG. 2*a*, top plate 21 may have four hooks 18 positioned such that electromagnet 10 is properly balanced and level during operation.

As best illustrated in FIG. 2*b*, top plate 21 and plates 22 through 25 define a generally rectangular internal housing cavity 28. Carved or molded into side plates 22 and 23 are a pair of opposing slots 26 and 27, respectively. Slots 26 and 27 face toward internal housing cavity 28. As will be discussed in greater detail below, opposing slots 26 and 27 cooperate to hold electromagnetic core 50 in place within housing 20 during the operation of electromagnet 10.

As illustrated in FIG. 2*a*, top plate 21 of housing 20 has a pair of cable inlets 40 and 41 which allow access to housing cavity 28. A cable housing 42 encloses and protects cable inlets 40 and 41 from the environment. In one embodiment, cable housing 42 is constructed of metal and welded to top plate 21. It will be appreciated, however, that cable housing 42 can be constructed of various materials. The positive and negative leads of a cable connected to an external power supply enter through an opening in the side of cable housing 42 (not shown). From there, the positive and negative leads enter cable inlets 40 and 41, respectively, and connect to electromagnetic core 50.

Figure 3:
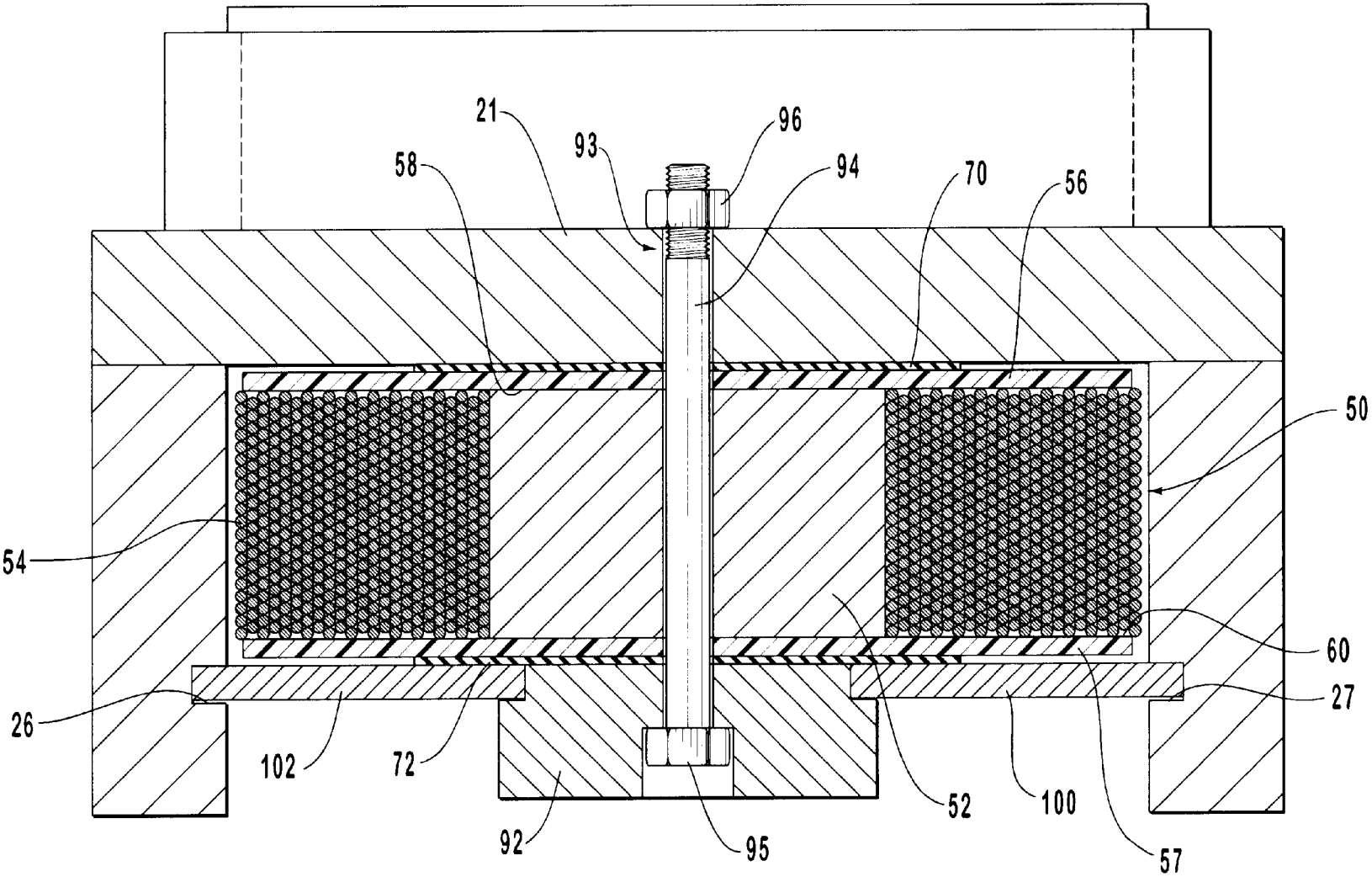
FIG. 3 is a cross sectional view of the electromagnet in FIG. 1 shown with the electromagnetic core disposed within the housing.

As illustrated in FIG. 3, disposed within housing 20 is a spool-shaped electromagnetic core 50. At the hub of electromagnetic core 50 is a pole piece 52. As shown in FIG. 4*a*, pole piece 52 is elliptically shaped. It will be appreciated, however, that pole piece 52 can take various shapes and forms. Pole piece 52 is made of iron or other ferromagnetic material. In one embodiment, silicone compound 60# Dow Corning 170 A & B is used.

As shown in FIG. 4*a*, pole piece 52 has a plurality of bolt holes 66. As best illustrated in FIG. 4*b*, bolt holes 66 pass completely through pole piece 52. When properly aligned within inner cavity 28 of housing 20, bolt holes 66 vertically align with bolt holes 34 on top plate 21. As discussed below, pole piece 52 additionally has a plurality of threaded screw holes 64. In one embodiment, the top and bottom faces of pole piece 52 have 10 threaded screw holes 64 evenly space around the perimeter. As illustrated in FIG. 4*b*, threaded screw holes 64 are bored only partially into pole piece 52. Pole piece 52 also has a channel 62. Channel 62 is used to elevate and rotate pole piece 52 to facilitate wrapping electrical wire 54 around pole piece 52.

With reference to FIG. 3, pole piece 52 is sandwiched by a pair of thermoresistant plates 56 and 57. In one embodiment, thermoresistant plates 56 and 57 are constructed of mica. Like pole piece 52, thermoresistant plates 56 and 57 are elliptically-shaped. The radius of thermoresistant plates 56 and 57 is greater than pole piece 52. The disparity is diameters defines an upper flange 58 and a lower flange 60.

Thermoresistant plates 56 and 57 are attached to pole piece 52 by a pair of plates 70 and 72. As illustrated in FIGS. 3, plates 70 and 72 sandwich pole piece 52 and thermoresistant plates 56 and 57. Plate 70 is positioned between thermoresistant plate 56 and top plate 21 of housing 20. The length of plate 70 is approximately the length of pole piece 52. As illustrated in FIG. 5, plate 70 has a plurality of screw holes 76. Screw holes 76 are evenly space around the perimeter of plate 70 and vertically align with threaded screw holes 64 of pole piece 52. In one embodiment, plate 70 is attached to pole piece 52 by threaded engagement. Screws (not shown) pass through screw holes 76 (and thermoresistant plate 56) and engage threaded screw holes 64 of pole piece 52. Plate 70 also has a plurality of bolt holes 82 and a channel 78. When plate 70 is fastened to pole piece 52, bolt holes 82 and channel 78 vertically align with bolt holes 66 and channel 62, respectively, of pole piece 52. A pair of notches 80 and 81 align with cable inlets 40 and 41, respectively, in top plate 21.

As illustrated in FIG. 6, plate 72 is similarly configured and similarly attaches to pole piece 52. Briefly, plate 72 has a plurality of bolt holes 88, a channel 86, and a plurality of screw holes 90. Plate 70 is attached to pole piece 52 by screws (not shown) that pass through screw holes 90 (and thermoresistant plate 57) and engage threaded screw holes 64 of pole piece 52. When plate 72 is fastened to pole piece 52, channel 86 and bolt holes 88 vertically align with channel 62 and bolt holes 66, respectively, of pole piece 52. Unlike plate 70, however, plate 72 does not require corresponding notches 80 and 81 to accommodate cable inlets 40 and 41 in top plate 21.

With reference to FIG. 3, wire 54 is wrapped around piece pole 52 of electromagnetic core 50. In one embodiment, 1125 turns of Phelps Dodge,#11 round Haptz wire 54 having a 16 ohms resistance is used. It will be appreciated that the type of wire 54 and number of turns will vary depending on the strength of the magnetic field desired; the number of turns and amperage being directly proportional to the magnetic strength of the electromagnet. Wire 54 is partially held in place by upper flange 58 and lower flange 60. The positive and negative ends of wire 54 are, respectively, connected to the positive and negative leads of the external power supply. From the center of pole piece 52, the connected electrical wires pass through notches 80 and 81 in plate 70, through cable inlets 40 and 41, and out cable housing 42 to the external power supply.

With continued reference to FIG. 3, electromagnetic core 50 is supported in part by a pair of braces 100 and 102 which are positioned within housing cavity 28. Braces 100 and 102 are generally rectangular. The length of braces 100 and 102 is approximately the length of inner cavity 28 measured from end plate 24 to end plate 25. The width of braces 100 and 102 is approximately one-third the width of housing cavity 28. The thickness of brace 100 and 102 is slightly smaller than opposing slots 26 and 27. When pole piece 52 is properly positioned withing housing cavity 28, one end of brace 100 is lodged into slot 26 and one end of brace 102 is lodged into slot 27.

As illustrated in FIGS. 3 and 7*a*, a center shoe 92 and a plurality of bolts 93 support braces 100 and 102 and, in turn, electromagnetic core 50 within housing cavity 28. The length of center shoe 92 is approximately the length of braces 100 and 102. As best illustrated in FIG. 7*b*, center shoe 92 has a top face 105 and a bottom face 106. The width of top face 105 is narrower than bottom face 106. The disparity in widths defines a pair of lips 103 and 104. As illustrated in FIG. 3, the inner distance separating braces 100 and 102 accommodates the width of top face 105 such that lips 103 and 104 overlap braces 100 and 102.

Center shoe 92 has a plurality of bolt holes 96. Bolt holes 96 have a bolt head recess 97 near bottom face 106. Bolt head recess 97 is larger in diameter that bolt holes 96. The disparity in diameters defines a plurality of shoulders 98. As shown in FIG. 7*b*, bolt head recess 97 is circular. It will be appreciated, however, that bolt head recesses 97 can take various shapes and sizes. For example, bolt head recesses 97 can be hexagonal in shape to correspond to the shape of the bolt head of screw 93. When properly positioned between braces 100 and 102, bolt holes 96 of center shoe 92 align with bolt holes 34 of top plate 21, bolt holes 66 of pole piece 52, and bolt holes 82 and 88 of plates 70 and 72, respectively. With the bolt holes vertically aligned, center shoe 92 is secured by bolts 93. Bolts 93 have partially threaded shafts 94 and bolt heads 95. Threaded shafts 94 of bolts 93 are inserted from the bottom face 106 of center shoe 92, and pass through bolt holes 96, 88, 66, 82 and exit bolt holes 34 in top plate 21 of housing 20. Bolts 93 are secured by nuts 96 which engage threaded shafts 94 near top plate 21. As nuts 96 are threaded to shafts 94, bolt head 95 becomes biased against shoulder 98. In turn, center shoe 92 becomes biased against braces 100 and 102, thus securing electromagnetic core 50 within housing cavity 28. As discussed above, bolt head recesses 97 can be hexagonal in shape to correspond to the shape of bolt head 95. This configuration prevents bolt 93 from freely rotating while nuts 96 are threaded to shafts 94.

Should electromagnetic core 50 become damaged during use and need to be repaired, a technician can easily disassemble, repair, and reassemble electromagnet 10. The technician first removes nuts 96 from threaded shafts 94 of bolts 93. Center shoe 92 is removed and braces 100 and 102 are dislodged from opposing slots 26 and 27. Electromagnetic core 50 is then removed from inner housing cavity 28. Once the necessary repairs are made to electromagnetic core 50, it is once again placed in inner housing cavity 28. Electromagnetic core 50 is positioned so that bolt holes 66 of pole piece 52, and bolt holes 82 and 88 of plates 70 and 72, respectively, are vertically aligned with bolt holes 34 in top plate 21 of housing 20. Once the bolt holes are properly aligned, brace 100 is lodged into slot 26 of side plate 22 and brace 102 is lodged into slot 27 of side plate 23. Center shoe 92 is then positioned between braces 100 and 102 with top face 105 toward electromagnetic core 50. With lips 103 and 104 overlapping braces 100 and 102, bolt holes 96 are aligned with bolt holes 88 on plate 72. With all the bolt holes aligned, bolts 93 are inserted into bolt holes 96 of center shoe 92 until threaded shaft 94 exits top plate 21 of housing 20. Nuts 96 are fastened to threaded shafts 94 of bolts 96 until electromagnetic core 50 is secure within housing cavity 28.

In summary, the present invention provides an electromagnet that is simple, easy to assemble and disassemble, and relatively inexpensive to build and maintain. The electromagnet of the present invention is easily and quickly assembled and disassembled, reducing the amount of down time resulting from damaged electrical coils. Specifically, the electromagnet design of the present invention contains fewer bolts than most conventional electromagnets. The present invention is also constructed such that the bolt holes are be easily aligned without the use of heavy lifting equipment.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electromagnet comprising:

a. a rectangular housing having a housing cavity, a side plate and a groove integrally formed in said side plate;

b. an electromagnetic core disposed within said housing cavity;

c. at least one rectangular brace lodged within said groove; and d. a center shoe engaging said brace and connected to said housing by a plurality of bolts wherein said groove, said at least one rectangular brace, and said center shoe cooperate to secure said electromagnetic core within said housing cavity.

2. The electromagnet of claim 1 wherein the housing has a pair of side plates and a pair of grooves.

3. The electromagnet of claim 1 wherein said electromagnetic core is secured by two braces.

4. The electromagnet of claim 3 wherein said center shoe is positioned between said braces.

5. The electromagnet of claim 1 wherein said center shoe is connected to said housing by six bolts.

6. An electromagnet comprising:

a. a rectangular housing having a housing cavity, a pair of side plates and pair of grooves, wherein each groove is integrally formed in one of said side plates;

b. an electromagnetic core disposed within said housing cavity;

c. a pair of rectangular braces lodged within said grooves slots an overlapping said electromagnetic core; and d. a center shoe engaging said rectangular braces and connected to said rectangular housing by a plurality of bolts;

wherein said grooves slot, said rectangular braces and said center shoe cooperate to secure said electromagnetic core within said housing cavity.

7. The electromagnet of claim 6 wherein said center shoe is positioned between said braces.

8. The electromagnet of claim 7 wherein said center shoe is connected to said housing by six bolts.

9. The electromagnet of claim 8 wherein said center shoe further comprises a pair of lips which engage said braces.

10. A method of securing an electromagnetic core within a rectangular electromagnet housing, said housing having a cavity, a side plate and a groove integrally formed in said side plate comprising:

a. placing an electromagnetic core within said housing cavity;

b. lodging at least one rectangular brace into said groove such that said at least one rectangular brace overlaps said electromagnetic core;

c. positioning a center shoe having a plurality of bolt holes within said cavity such that said center shoe engages said at least one rectangular brace; and d. securing said center shoe to said housing by a plurality of bolts.

11. The method of securing an electromagnetic core within an electromagnet housing of claim 12 wherein the housing has a pair of side plates and a pair of grooves.

12. The method of securing an electromagnetic core within an electromagnet housing of claim 10 wherein said electromagnetic core is secured by two braces.

13. The method of securing an electromagnetic core within an electromagnet housing of claim 12 wherein said center shoe is positioned between said braces and supports said electromagnetic core.

14. The method of securing an electromagnetic core within an electromagnet housing of claim 10 wherein said center shoe is connected to said housing by six bolts.

15. An electromagnet comprising:

a. a rectangular housing having a cavity, a pair of side plates and a pair of grooves, wherein each groove is integrally formed in one of said side plates;

b. an electromagnet core; and c. means for supporting said electromagnetic core within said housing cavity.

16. The electromagnet of claim 15 wherein said supporting means comprises a center shoe.

17. The electromagnet of claim 16 wherein said supporting means comprises a pair of rectangular braces.

* * * * *